US006736432B2

(12) United States Patent
Huang et al.

(10) Patent No.: US 6,736,432 B2
(45) Date of Patent: May 18, 2004

(54) COMBINATION STRUCTURE OF THE ASSEMBLY PLATES AND THE CYLINDER OF A LOCK LATCH

(75) Inventors: Chih-Cheng Huang, Kaohsiung Hsien (TW); Chao-Ming Huang, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 10/095,939

(22) Filed: Mar. 13, 2002

(65) Prior Publication Data

US 2003/0173785 A1 Sep. 18, 2003

(51) Int. Cl.[7] ..... E05C 1/00
(52) U.S. Cl. ..... 292/1.5; 292/337; 292/163
(58) Field of Search ..... 292/1.5, 337, DIG. 64

(56) References Cited

U.S. PATENT DOCUMENTS 3,792,887 A * 2/1974 Ramsey ..... 292/169.21
4,372,594 A * 2/1983 Gater ..... 292/1.5
4,950,008 A * 8/1990 Fang ..... 292/1.5
4,957,315 A * 9/1990 Lin ..... 292/1.5
5,267,457 A * 12/1993 Sorensen et al. ..... 292/150
5,354,109 A * 10/1994 Lin ..... 292/1.5
5,501,492 A * 3/1996 Kajuch ..... 292/1.5
5,516,160 A * 5/1996 Kajuch ..... 292/1.5
5,613,715 A * 3/1997 Kim ..... 292/1.5
5,743,573 A * 4/1998 Huang ..... 292/1.5
5,918,916 A * 7/1999 Kajuch ..... 292/163
6,113,160 A * 9/2000 Johansson et al. ..... 292/169
6,164,099 A * 12/2000 Sh ..... 292/336.3
6,318,769 B1 * 11/2001 Kang ..... 292/1.5
6,390,515 B1 * 5/2002 Huang ..... 292/169.14

* cited by examiner

*Primary Examiner*—James R. Brittain
*Assistant Examiner*—Thomas Y Ho
(74) *Attorney, Agent, or Firm*—Bacon & Thomas, PLLC

(57) ABSTRACT

A combination structure of the assembly plates and the cylinder of a lock latch includes a cylinder, a first assembly plate, and a second assembly plate. The cylinder is formed with a slot which has a top end and a bottom end each formed with a locking recess, and has a first side and a second side each formed with at least one side recess. The first assembly plate is provided with at least one locking groove locked with the side recess of the first side of the slot, and is provided with a reinforcement plate locked in the locking recess of the slot of the cylinder. The second assembly plate is provided with multiple hooks locked in the side recess of the second side of the slot, and at least one recess for locking the side plate of the first assembly plate.

2 Claims, 3 Drawing Sheets

COMBINATION STRUCTURE OF THE ASSEMBLY PLATES AND THE CYLINDER OF A LOCK LATCH

BACKGROUND OF THE INVENTION

1. Field of the Invention

The present invention relates to a combination structure of the assembly plates and the cylinder of a lock latch, and more particularly to a combination structure of the assembly plates and the cylinder of a lock latch having a greater strength.

2. Description of the Related Art

A conventional lock tongue structure of a lock latch in accordance with the prior art is disclosed in the applicant's U.S. Pat. No. 6,186,562, and is shown in FIG. 1. The lock latch includes a cylinder 90 having a bottom connected with two assembly plates 91 and 92. The bottom of the cylinder 90 is formed with a slot 93 which has a first side formed with two breaches 94 and a second side provided with two lugs 95. The assembly plate 91 is provided with two pieces 96 locked in the breaches 94 of the first side of the bottom of the cylinder 90. The assembly plate 92 is formed with two openings 97 for locking the lugs 95 of the second side of the bottom of the cylinder 90.

Thus, the cylinder 90 of the lock latch may be combined with the assembly plates 91 and 92 of the lock latch. However, in use, when the assembly plates are subjected to the press force of the handle during a long period of time, or are hit by a larger external force, the lock latch is easily loosened, especially when the lock latch is used in a flat handle having a larger torque.

SUMMARY OF THE INVENTION

The primary objective of the present invention is to provide a combination structure of the assembly plates and the cylinder of a lock latch, wherein the assembly plates and the cylinder may be combined rigidly and stably.

In accordance with the present invention, there is provided a combination structure of the assembly plates and the cylinder of a lock latch, comprising:

a cylinder, containing lock latch elements therein, the cylinder having a bottom formed with a slot, the slot having a top end and a bottom end each formed with a locking recess, the slot having a first side formed with at least one side recess, and a second side formed with at least one side recess;

a first assembly plate, provided with at least one locking groove that may be locked with the side recess of the first side of the slot of the bottom of the cylinder, the first assembly plate having a top end and a bottom end each formed with at least one side plate and a reinforcement plate, the reinforcement plate being locked in the locking recess of the top and the bottom of the slot of the cylinder; and a second assembly plate, having one end provided with multiple hooks locked in the side recess of the second side of the slot of the bottom of the cylinder, the second assembly plate being formed with at least one recess for locking the side plate of the first assembly plate.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
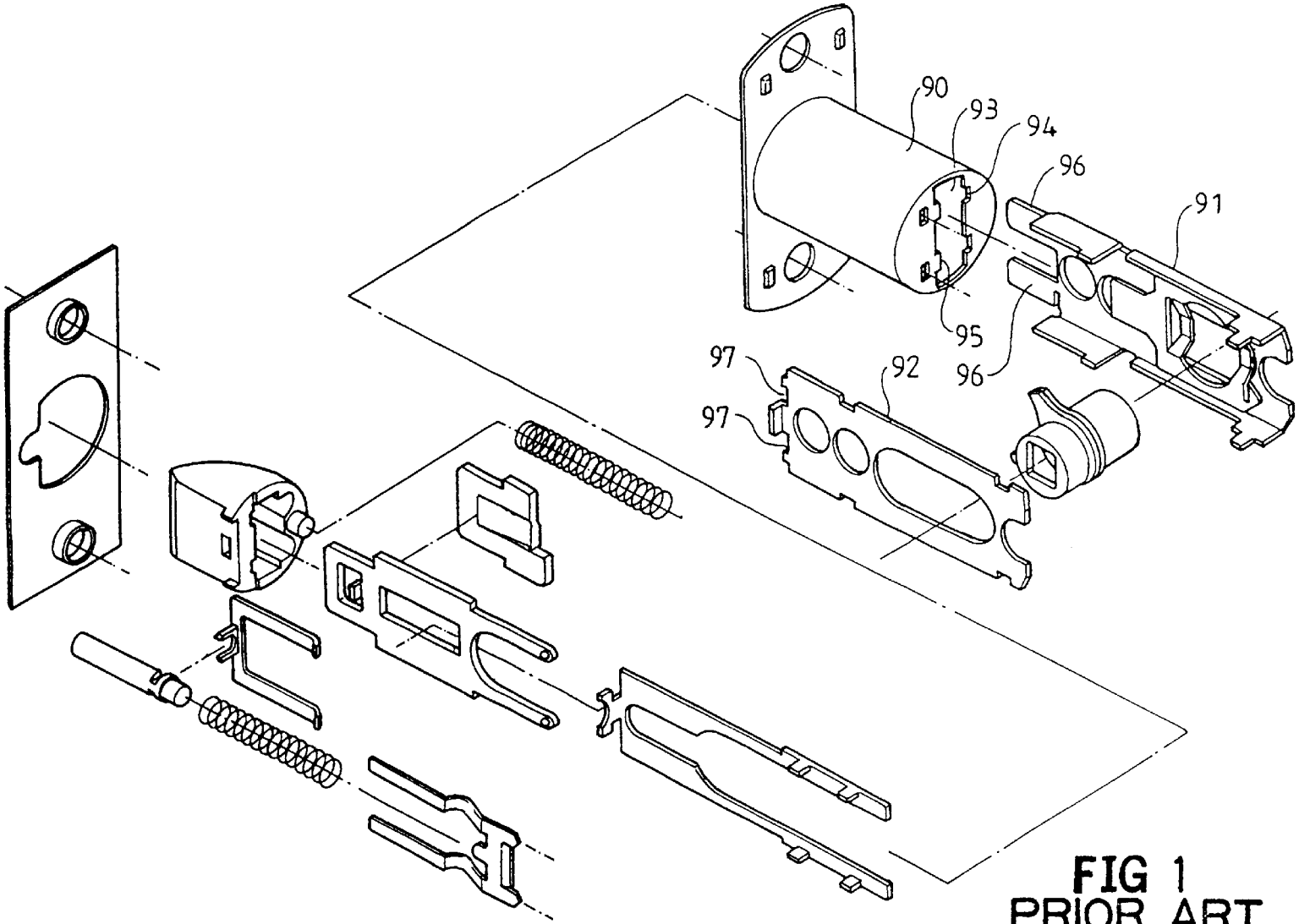
FIG 1 PRIOR ART
FIG. 1 is an exploded perspective cross-sectional assembly view of a conventional lock tongue structure of a lock latch in accordance with the prior art.
Figure 2:
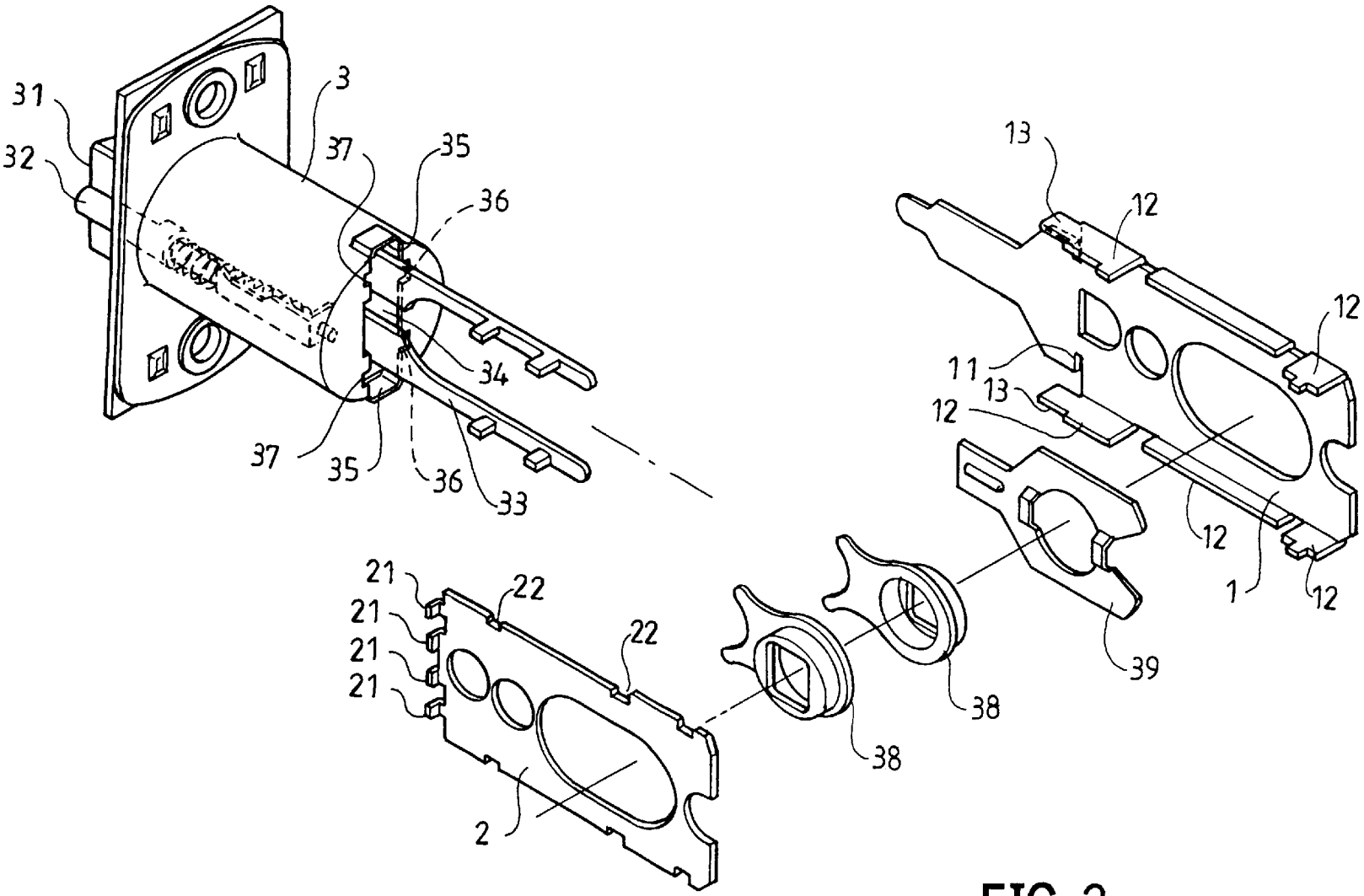
FIG. 2 is an exploded perspective view of a combination structure of the assembly plates and the cylinder of a lock latch in accordance with a preferred embodiment of the present invention.

Referring to the drawings and initially to FIG. 2, a combination structure of the assembly plates and the cylinder of a lock latch in accordance with a preferred embodiment of the present invention comprises a first assembly plate 1, a second assembly plate 2, and a cylinder 3.

The cylinder 3 may be provided with a lock tongue 31, a theftproof rod 32, and a drive plate 33. The cylinder 3 has a bottom formed with a slot 34. The slot 34 has a top end and a bottom end each formed with a locking recess 35. The locking recess 35 may be punched from the cylinder 3 itself toward the outer surface of the cylinder 3. The slot 34 has a first side formed with two side recesses 36, and a second side formed with two side recesses 37. The side recesses 36 may be aligned with the side recesses 37, or the side recesses 36 are not aligned with the side recesses 37.

The first assembly plate 1 is combined on one side of the slot 34 of the bottom of the cylinder 3, and is combined with the second assembly plate 2, so that two drive wheels 38 and an elongated member 39 may be received between the first assembly plate 1 and the second assembly plate 2, so that the lock latch has two different use sizes. The first assembly plate 1 is provided with two locking grooves 11 that may be locked with the side recesses 36 of the first side of the slot 34 of the bottom of the cylinder 3. The first assembly plate 1 is formed with multiple side plates 12 and reinforcement plates 13 in a bending manner. The side plates 12 may combined with the second assembly plate 2, and may be used to limit and prevent from detachment of the drive wheels 38 and the elongated member 39. Each of the reinforcement plates 13 may be locked in one of the locking recesses 35 of the cylinder 3, so that the first assembly plate 1 may be combined with the cylinder 3 rigidly and stably in a soldering manner.

The second assembly plate 2 has one end provided with multiple hooks 21 that may be locked in the side recesses 37 of the second side of the slot 34 of the bottom of the cylinder 3. The second assembly plate 2 is formed with multiple recesses 22 for locking the side plates 12 of the first assembly plate 1, thereby preventing from detachment of the drive wheels 38 and the elongated member 39.

Figure 3:
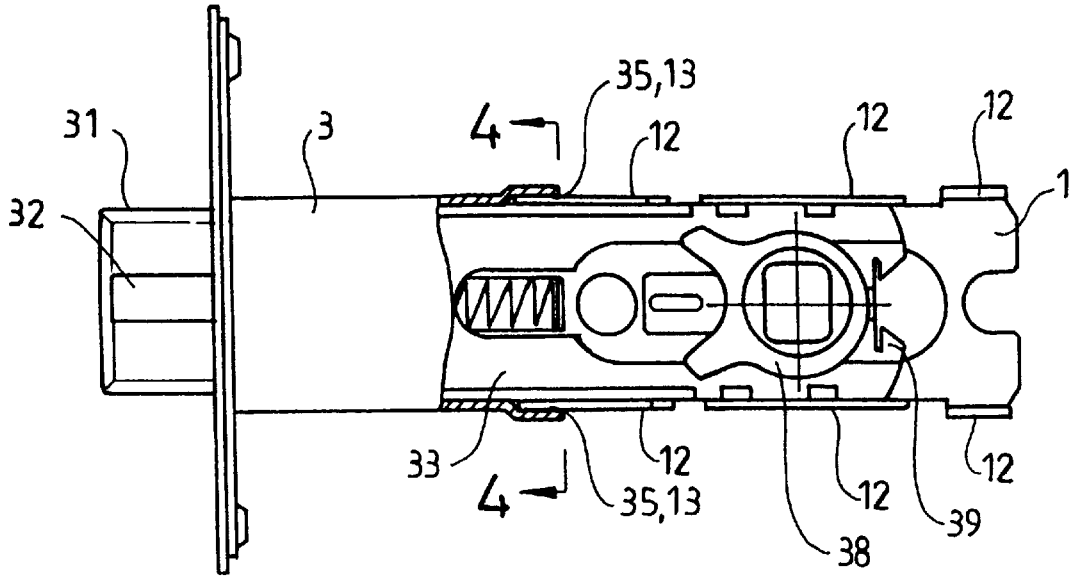
FIG. 3 is a front plan locally cross-sectional assembly view of the combination structure of the assembly plates and the cylinder of a lock latch as shown in FIG. 2.
Figure 4:
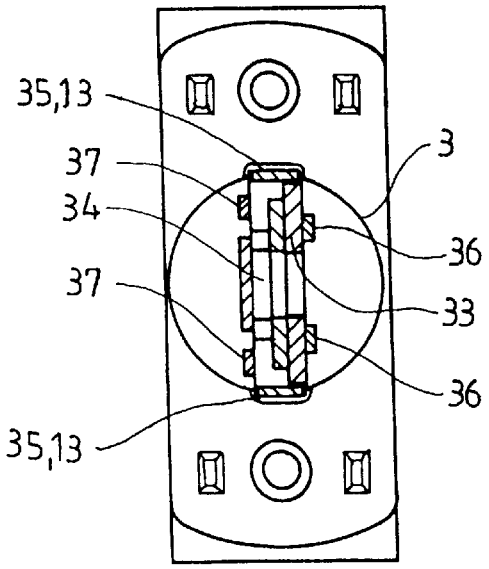
FIG. 4 is a cross-sectional view of the combination structure of the assembly plates and the cylinder of a lock latch taken along line 4—4 as shown in FIG. 3.

Referring to FIGS. 3 and 4, the combination situation of the combination structure of the assembly plates and the cylinder of a lock latch in accordance with a preferred embodiment of the present invention is shown. The locking grooves 11 of the first assembly plate 1 are locked with the side recesses 36 of the first side of the slot 34 of the bottom of the cylinder 3, and the reinforcement plates 13 of the first assembly plate 1 are locked in the locking recesses 35 of the cylinder 3, so that the first assembly plate 1 may be combined with the cylinder 3 rigidly and stably in a soldering manner. In addition, the hooks 21 of the second assembly plate 2 are locked in the side recesses 37 of the second side of the slot 34 of the bottom of the cylinder 3, and the second assembly plate 2 is combined with the first assembly plate 1.

Accordingly, in the combination structure of the assembly plates and the cylinder of a lock latch in accordance with a preferred embodiment of the present invention, the first assembly is additionally provided with reinforcement plates, and the cylinder is provided with locking recesses. Thus, when the first assembly is combined in the cylinder, the reinforcement plates of the first assembly plate are locked in the locking recesses of the cylinder, so that the combination structure of the assembly plates and the cylinder may have a greater strength and torque. Especially, the reinforcement plates of the first assembly plate may be secured in the locking recesses of the cylinder in a soldering manner, thereby providing a rigid and stable combination therebetween.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination structure of the assembly plates and the cylinder of a lock latch, comprising:

a cylinder containing lock latch elements therein, the cylinder having a bottom formed with a slot, the slot having a top end and a bottom end each formed with a locking recess which is recessed outwardly on an outer circumference of the cylinder, the locking recesses are elongated, the slot having a first side formed with at least one side recess, and a second side formed with at least one side recess;

a first assembly plate provided with at least one locking groove that is locked with the side recess of the first side of the slot of the bottom of the cylinder, the first assembly plate having a top end and a bottom end each formed with at least one side plate and a reinforcement plate, the reinforcement plates of the first assembly plates each being locked in a corresponding one of the locking recesses of the top and the bottom of the slot of the cylinder, the reinforcement plate is combined with the locking recess of the cylinder in a soldering manner; and a second assembly plate having one end provided with multiple hooks locked in the side recess of the second side of the slot of the bottom of the cylinder, the second assembly plate being formed with at least one recess for locking the side plate of the first assembly plate.

2. The combination structure of the assembly plates and the cylinder of a lock latch as claimed in claim 1, wherein the cylinder is directly punched to form the locking recess.

* * * * *